US007389983B2

(12) United States Patent
Berdelle-Hilge et al.

(10) Patent No.: US 7,389,983 B2
(45) Date of Patent: Jun. 24, 2008

(54) INPUT UNIT OF A LETTER SORTING SYSTEM AND METHOD FOR LOADING THE INPUT UNIT

(75) Inventors: Peter Berdelle-Hilge, Constance (DE); Christoph Hofmann, Salem (DE)

(73) Assignee: Siemens Aktiengesellschaft, Munich (DE)

( * ) Notice: Subject to any disclaimer, the term of this patent is extended or adjusted under 35 U.S.C. 154(b) by 301 days.

(21) Appl. No.: 11/245,133

(22) Filed: Oct. 7, 2005

(65) Prior Publication Data

US 2006/0056954 A1 Mar. 16, 2006

Related U.S. Application Data

(62) Division of application No. 10/370,510, filed on Feb. 24, 2003, now Pat. No. 7,182,331.

(51) Int. Cl.
*B65H 1/26* (2006.01)

(52) U.S. Cl. ..... 271/157; 271/158; 271/162

(58) Field of Classification Search ..... 271/157, 271/158, 162, 149, 150
See application file for complete search history.

(56) References Cited

U.S. PATENT DOCUMENTS 5,044,877 A * 9/1991 Constant et al. ..... 414/798.9
5,244,199 A * 9/1993 Wood ..... 271/150
5,657,982 A * 8/1997 Holmes et al. ..... 271/149
5,906,468 A 5/1999 Vander Syde et al.
5,947,468 A 9/1999 McKee et al.
6,017,029 A * 1/2000 Bates et al. ..... 271/3.12
6,220,590 B1 * 4/2001 Bates et al. ..... 271/3.01
6,354,587 B1 * 3/2002 Engarto ..... 271/149
6,749,193 B2 * 6/2004 Berdelle-Hilge et al. .... 271/149
7,182,331 B2 * 2/2007 Berdelle-Hilge et al. .... 271/150

FOREIGN PATENT DOCUMENTS

DE 4236507 12/1993
EP 0865328 6/1997

OTHER PUBLICATIONS

Derwent Abstract DE-4236507-C1, Licentia Patent-Verwaltungs-GmbH, D-60596 Frankfurt (Germany).

* cited by examiner

*Primary Examiner*—David H Bollinger

(57) ABSTRACT

The present invention relates to an input unit of a letter sorting system which comprises separable first and second conveyor lines. The first line is positioned proximate to an isolating device which processes letters. The first line comprises a conveyor surface and supporting wall along with a linear guide which extends beyond the surface. On the linear guide runs a separating blade. The second line also comprises a conveyor surface and supporting wall along with a linear guide, however this linear guide does not run beyond the length of the second conveyor line supporting surface. At least one second separating blades run on the second conveyor line linear guide. In operation, letters are placed on the second conveyor supporting surface from bins. The placement may be in a select order. The second conveyor line is then brought proximate to the first conveyor line where the two are then coupled. The conveyor surfaces of the two lines substantially mate so as to facilitate transported by a separating blade of the letters from the second to the first conveyor line and then to the isolating unit for processing.

3 Claims, 7 Drawing Sheets

INPUT UNIT OF A LETTER SORTING SYSTEM AND METHOD FOR LOADING THE INPUT UNIT

CONTINUATION DATA

The present invention is a Divisional Patent Application based on Utility patent application Ser. No. 10/370,510, filed Feb. 24, 2003 now U.S. Pat. No. 7,182,331 with the United States Patent Office.

STATEMENT REGARDING FEDERALLY SPONSORED RESEARCH OR DEVELOPMENT

Not applicable.

REFERENCE TO SEQUENCE LISTING, A TABLE, OR A COMPUTER PROGRAM LISTING COMPACT DISK APPENDIX

Not applicable.

BACKGROUND OF THE INVENTION

The present invention relates to an input unit of a letter sorting system including a mail or letter isolating device connected to a mail conveyor line and oriented horizontally with a supporting wall. Relatively flat mail pieces are transported, with the assistance of separation blades, to the isolating device. The mail pieces are standing on edge. The separation blades may be made to swivel into a stack of mail pieces in facilitating transport of a select portion of the stack as well as provide support therefor. The separation blades further run on linear guides which facilitate linear transport of a select stack portion.

To date, input units are loaded manually. This is a rather expensive undertaking. Herein, mail pieces are dumped from a mail container of a mail conveyor line, or manually removed stack-wise from the mail container, and put on the mail conveyor line. Thereafter, the mail pieces are moved, again by hand, along a supporting base and oriented sidewise against a supporting wall and to the mail isolating device. The separating blade is then swivelled in behind the stack and mail separation or isolation starts. The separating blade and additionally the optional mail conveyor line, which is executed as conveyor coupled with the separating blade, supplies the stack in a pressure-controlled manner to the isolating device.

EP 0865328 B 1 sets out an installation for an automatic loading of an input unit of a letter sorting system without manual input. A loaded container is thereby emptied by a loading module on the mail conveyor line of the input unit between two additional, moveable and swivelling separating blades. Then the stack is automatically moved to the remaining stack by the two separating blades in a direction of the mail isolating device. The separating blade, which supports the remaining stack, extends, advances closely behind the additional rear separating blade, swivels in again and the two additional separating blades swivel out and advance to the back for the capture of a new stack. With this solution too, the mail pieces get to the input unit in a mail container, i.e. the mail pieces have to be loaded in the mail containers in a relatively expensive manner. These mail pieces come in many cases from pre-arranged sorting machines. Then the pre-sorted mail pieces are loaded from the respective sorting bins into the mail containers and, as described, transported to the corresponding input unit.

There are also sorting processes with several successive sorting runs, where the mail pieces from the sorting bins are not loaded into the mail containers, but moved by a transfer bridge from the sorting bins on the mail conveyor line of the input unit (see e.g. DE 42 36 507 C1). For this, a certain machine layout is necessary where the sorting bins and the mail conveyor line of the input unit are opposing.

SUMMARY OF THE INVENTION

The present invention is directed to a letter sorting system input unit and a method for loading it wherein mail piece loading assistance from prearranged sorting plants into mail containers is no longer necessary; or no requirements regarding the spatial arrangement of input unit and sorting bins are necessary for machine-layouts with sorting processes of several sorting runs; whereby the respectively sorted mail pieces are fed directly to the input unit again without a mail container.

The execution of a mail conveyor line as a divided mail conveyor line, whereby a relatively short first section is, as up until now, connected firmly to the mail isolating device, and at least one longer second section, connectable to the short section, which is arranged travelling on an carriage, permits the direct loading of the mail conveyor line at any location without using mail containers. The second section of the mail conveyor line is thereby carried to the loading location and the mail pieces are placed on the second section. One or two separating blades are pushed towards the stack along the second section so that the mail stack does not turn over. If the mail stack is not too long, one separating blade is sufficient at a determined oblique position; otherwise support on both sides with two separating blades is preferred, particularly with uncontrolled transport motions. A supporting wall, which is connected to a first section of the mail conveyor line, has a length over the entire mail conveyor line. The separating blade of the first short section of the mail conveyor line travels over the length of the entire mail conveyor line, i.e. if the second section is coupled, this first separating blade can be advanced, extended behind the rear separating blade of the second section, and, after joining with the optional remaining stack on the first section and the swivelling out of the separating blades of the second section, move the entire stack to the isolating device. The separating blades are placed in such a way, that they don't hinder each other while in motion.

So it is advantageous to carry out the first section of the mail conveyor line at least as long as is sufficient to isolate or sort a mail stack standing on it, to disconnect the coupled and by now empty second section of the mail conveyor line, and to couple a new, loaded second section to the first section. It is thereby possible to operate the mail isolating device for a sorting run without interruption.

It is further advantageous to place the separating blade of the first section and the separating blade or blades of the second section guided on both sides of the mail conveyor line and moveable along the conveyor line in order to avoid mutual interference when the separating blades are in motion.

It is also advantageous to move the first separating blade of the mail conveyor line in a direction of the mail isolating device by a shifting device which keeps the measured stacking pressure constantly regulated at the mail isolating device. Practically similar emptying conditions are thereby met during the separating of the entire mail stack.

To carry out the transport of the mail pieces to the mail isolating device as stress-free as possible, the base of the first and the second section of the mail conveyor line each comprise at least a partially rough conveyor belt which are substantially synchronized with the first swiveling separating blade when the mail stack is moved to the mail isolating device.

During the connection of the two sections, the drives of the two conveying belts, advantageously via use of friction wheels, may also be so coupled.

To prevent mail piece dislocation during the pushing together of mail pieces of the loading process of the second section, the pushing being against the rear separating blade in a direction of the mail isolating device, the conveying belt may be limited to a motion only in a direction of the mail isolating device.

It is further advantageous, to advance the second section of the mail conveyor line to the sorting bins of any letter sorting system and to load from the sorting bins. These are advantageously the sorting bins of the letter sorting system, which input unit has to be loaded several times, at a sorting process with several sorting runs.

The present invention still further comprises CLAIM 1

BRIEF DESCRIPTION OF THE SEVERAL VIEWS OF THE DRAWINGS

The novel features and method steps believed characteristic of the invention are set out in the claims below. The invention itself, however, as well as other features and advantages thereof, are best understood by reference to the detailed description, which follows, when read in conjunction with the accompanying drawing, wherein:

DETAILED DESCRIPTION OF THE INVENTION

The mail pieces in the example described here are sorted in the sorting order for the letter carriers. Because the sorting plant only possesses a limited number of sorting bins 14, this must be carried out in several successive sorting runs, whereby the mail pieces of the input unit are fed to the sorting bins in exactly the sorted order again.

The mail pieces are stacked upright from the back to the front in the sorting bins 14, whereby they are supported towards the front by a swivelling out pallet pressed against the growing stack by resilience. The emptying of the sorting bins 14 and the loading of a mobile second section 30 of the mail conveyor line of the input unit can then occur easily by moving the mail stack from the sorting bin 14 on the second section 30.

The sequence functionality should be pictured for the letter sorting system by a multistaged sorting of the mail pieces. The used sorting strategy is based on a two-pass process:

1. The mail pieces are loaded on the second section of the mail conveyor line and singularized.
2. After completion of the first run, the mail pieces are brought back to the input unit and singularized a second time. The emptying order of the sorting bins per sorting bin must thereby not be interchanged.
3. After the second pass, the mail pieces are packed into the transport containers.

The mail stacks are loaded from the sorting bins 14, after the first run of one or several second sections 30 of the mail conveyor line, located on carriage, which are distributed along the letter sorting system. The individual mobile sections are then advanced to the input unit and emptied.

Figure 1A:
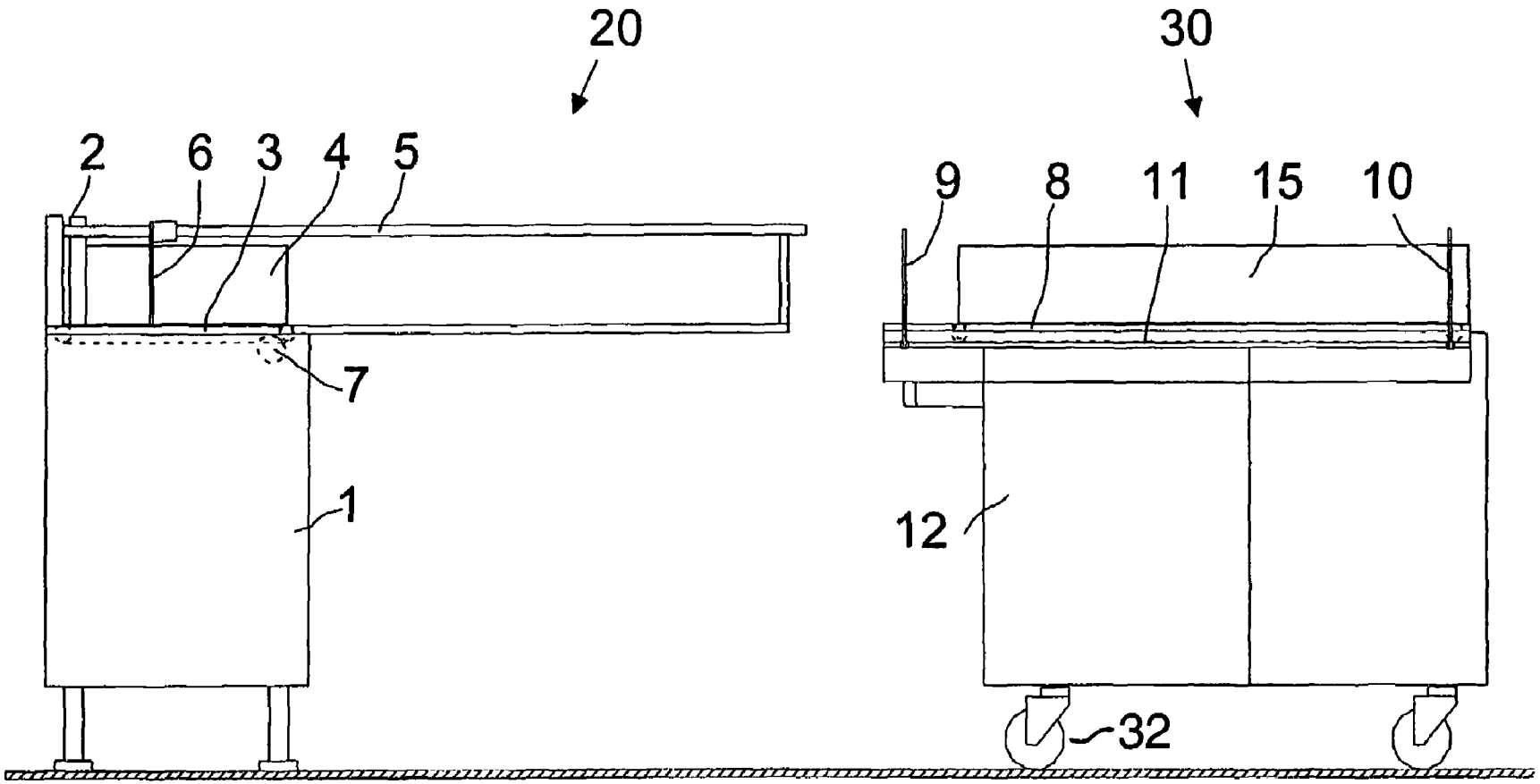
FIG. 1*a* depicts a schematic side view of the input unit with uncoupled conveyor lines.
Figure 1B:
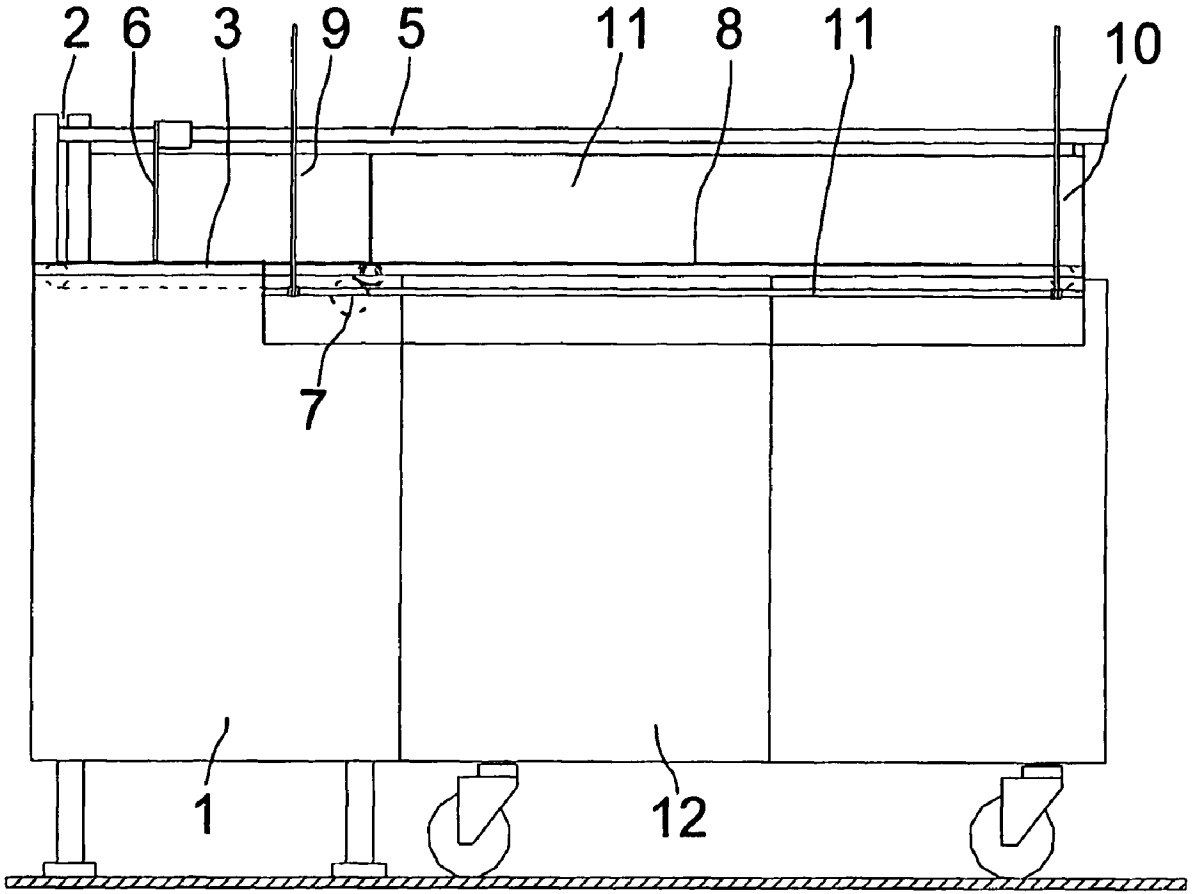
FIG. 1*b* depicts a schematic side view of the input unit with coupled conveyor lines.

As can be gathered from FIG. 1, the second section 30 of the mail conveyor line is attached on a carriage 12. It possesses a base 8, two separating blades 9, 10 swivelling in and out to the conveyor line and moveable along the second section at linear guides 11 as well as a supporting wall 15, where the upright mail pieces orient themselves. The base 8 of the second section is located at the same height as the base 3 of the first section 20 of the mail conveyor line of the input unit. Are the swivelled out separating blades 8, 9 moved to the ends of the stack and then swivelled in and interlocked in the base 8, a sliding or toppling over of the stack is prevented. The first section 20 of the mail conveyor line, rigidly connected to the mail isolating device 2, is directed with its transport direction rectangular to the emptying device 2 of the mail isolating device. The mail pieces orient themselves at a supporting wall 4 with their rear edge. Linear guides 5 are attached at the first section 20 of the mail conveyor line, where a first separating blade 6 is swivelling into and out of the mail conveyor line and moveable along the mail conveyor line. The base 3 of the first section is carried out as conveying belt. The drive of the separating blade 6 and the conveying belt is controlled by a stacking pressure, measured at the emptying location, that this stacking pressure stays mostly constant. The linear guides 5 shows a length which corresponds to the sum of the lengths of the first 20 and the second section 30 of the mail conveyor line.

The length of the first section 20 is chosen in such way that the time is sufficient to singularize the mail pieces standing on it, to carry away the meanwhile empty second section 30, to couple a ready and loaded second moveable section 30 including the shifting of the first separating blade 6 behind the separating blade 10 supporting the mail stack and rear, when seen from the mail isolating device, and the swivelling in of the first separating blade 6 into the conveyor line of the mail pieces and the subsequent swivelling out of the additional separating blade 9, 10 of the second section 30. The operation of the mail isolating device doesn't have to be interrupted like this. The second mobile section 30 of the mail conveyor line is attached on a carriage 12. Its transport surface shows the same height as the one of the first section.

The ends of the two sections 20, 20, which are coupled together, are formed out in such a way, that they seize into one another with a tooth characteristic, so that no disturbing gap is produced.

The second section possesses a conveying belt as base 8 as well and when the second section 30 is coupled to the first section 20, the powered conveying belt of the first section is coupled by a friction wheel 7 with the conveying belt of the second section 30, so that both are powered evenly.

The conveying belt of the second section 30 is only moveable in direction mail isolating device, so that the mail pieces don't slip away when pushed together during the loading process against the rear swivelled in separating blade 9 in direction of the mail isolating device, which supports itself on the conveying belt and is connected to it form and force-fit.

Figure 2A:
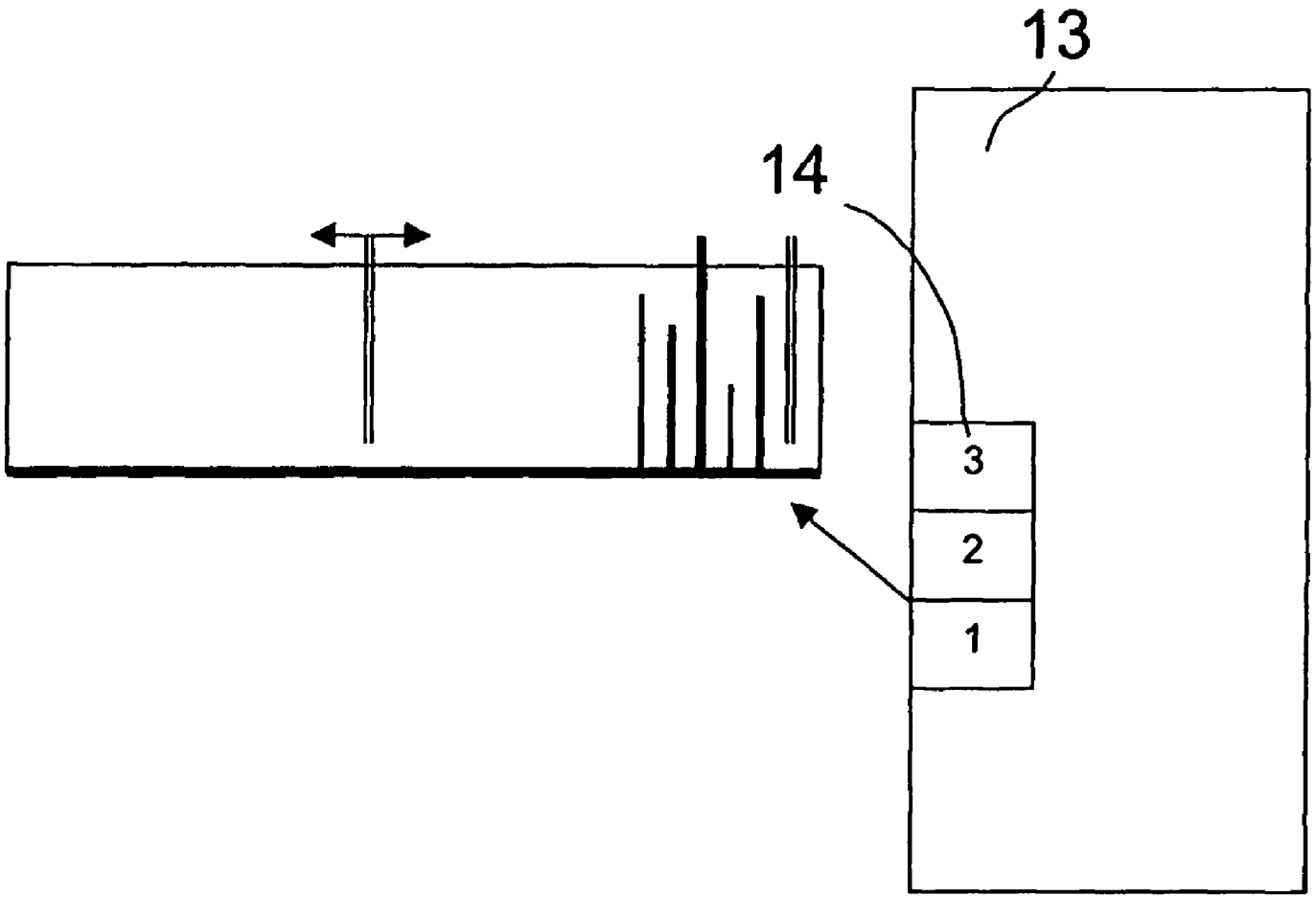
FIGS. 2*a* and 2*b* depict different second section loading schemes.

For the loading in a first version (FIG. 2*a*), the second section of the mail conveyor line located on a carriage, is put in a 90° angle against the bin wall 13 with the sorting bins 14. It is started with the content of bin no. 1, which is deposited to the left of the front separating blade; afterwards the content of bin no. 2 is deposited to the left of it, etc.

With the separating blade no. 2 of the second section, a turn-over to the left of the stack can be prevented. This separating blade is only prompted in the practice if the deposited stack exceeds a certain oblique position. At a length of the second section of for example 1 m, 3 shifts need to be calculated per load.

Figure 2B:
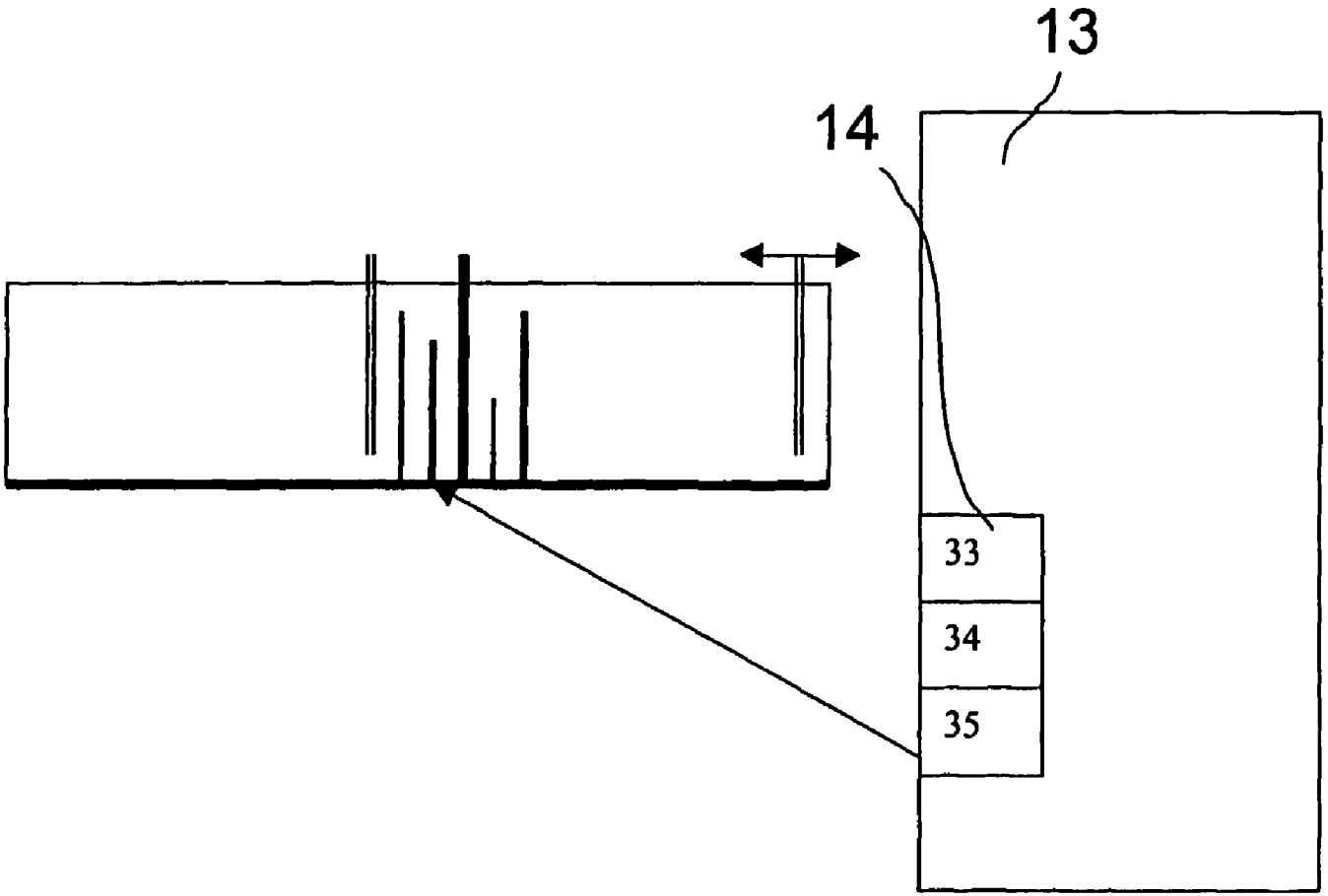

At a second possible version (FIG. 2*b*), the mail pieces are distributed from the front to the back with decreasing numbers. The separating blade no. 2 stands first of all for example in the center of the second section, the stack from the sorting bin 14 with the highest number is then deposited to its right, etc. Is the right half of the second section loaded, this stack is then moved to the left. This process can also occur more often with respective smaller stacks. The aim of this process is to have the loading station always as closely as possible to the bin wall, to minimize the distances during the loading of the second section.

Because the maximal loading degree for the sorting bins can be exceeded in exceptional cases, so-called overflow-bins are provided. These have to also be emptied in the right order (is bin no. 4 allocated to an overflow bin no. 4+, bin no. 4 is first emptied and subsequently no. 4+). Therefore, they are efficiently distributed evenly over the sorting plant in such a way, that their emptying can always be outgoing from the stack receiver. The minimal distance is thereby covered for the emptying of the sorting bins on the second section of the mail conveyor line.

By usage of lamp tracers as steering gear for the emptying order, the operator is guided.

| | |
|---|---|
| steady light = | bin filled |
| flashing light = | next bin to be emptied |
| no extinction after = acknowledgement | an additional overflow bin has to be emptied. |

After emptying of the entire letter sorting system on the second sections, these are moved (twist-free) to the input unit.

The first section 30 to be emptied is the one with stack from bin no. 1 at its right end. This is the second section standing closest to the input unit for the above described first version. For the second version, this would be the second section at the end of the letter sorting system.

Figure 3A:
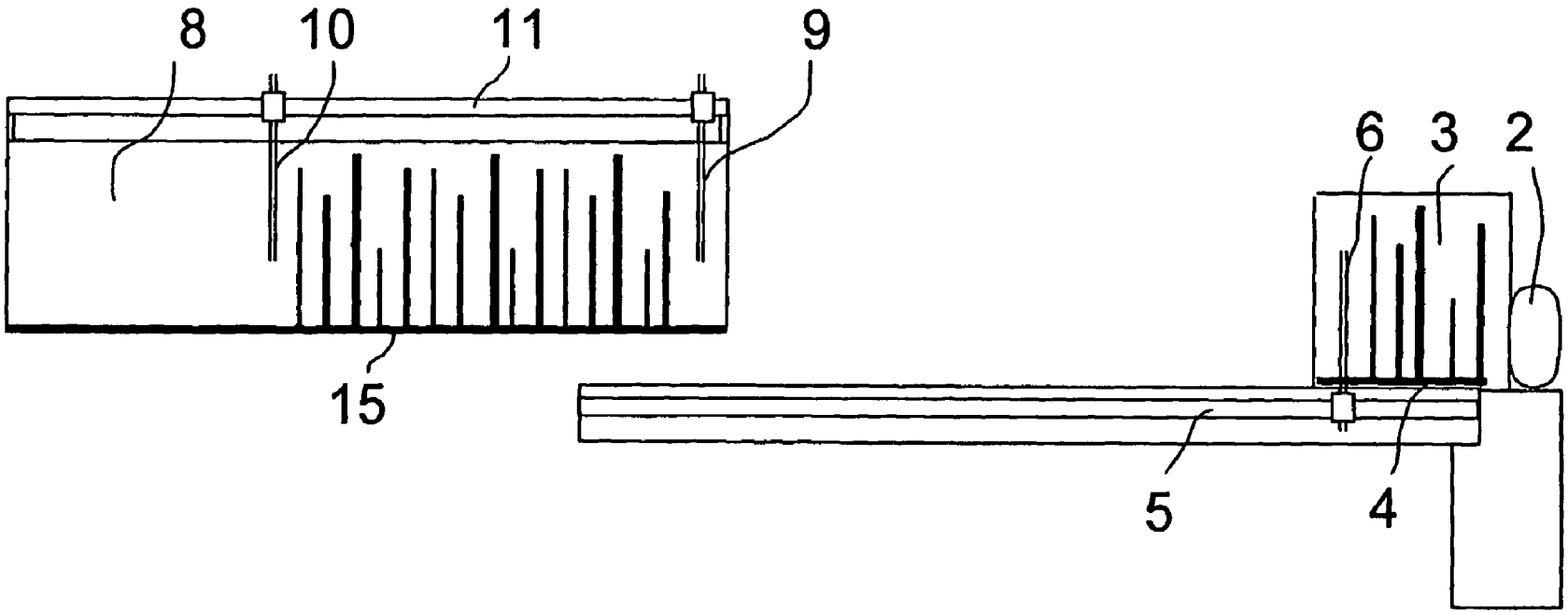
FIGS. 3*a*, 3*b* and 3*c* depict several phases of a loading process in schematic form.
Figure 3B:
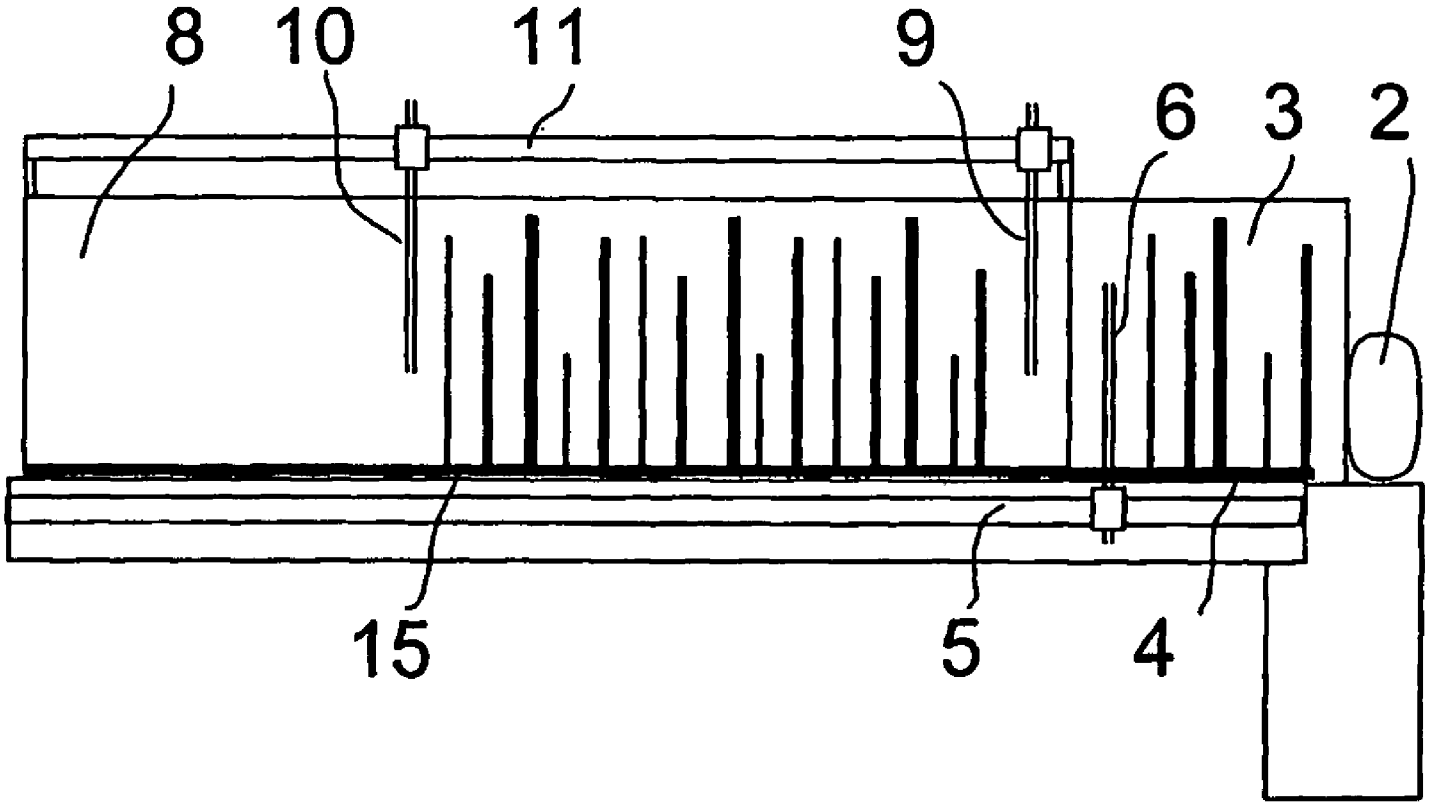
Figure 3C:
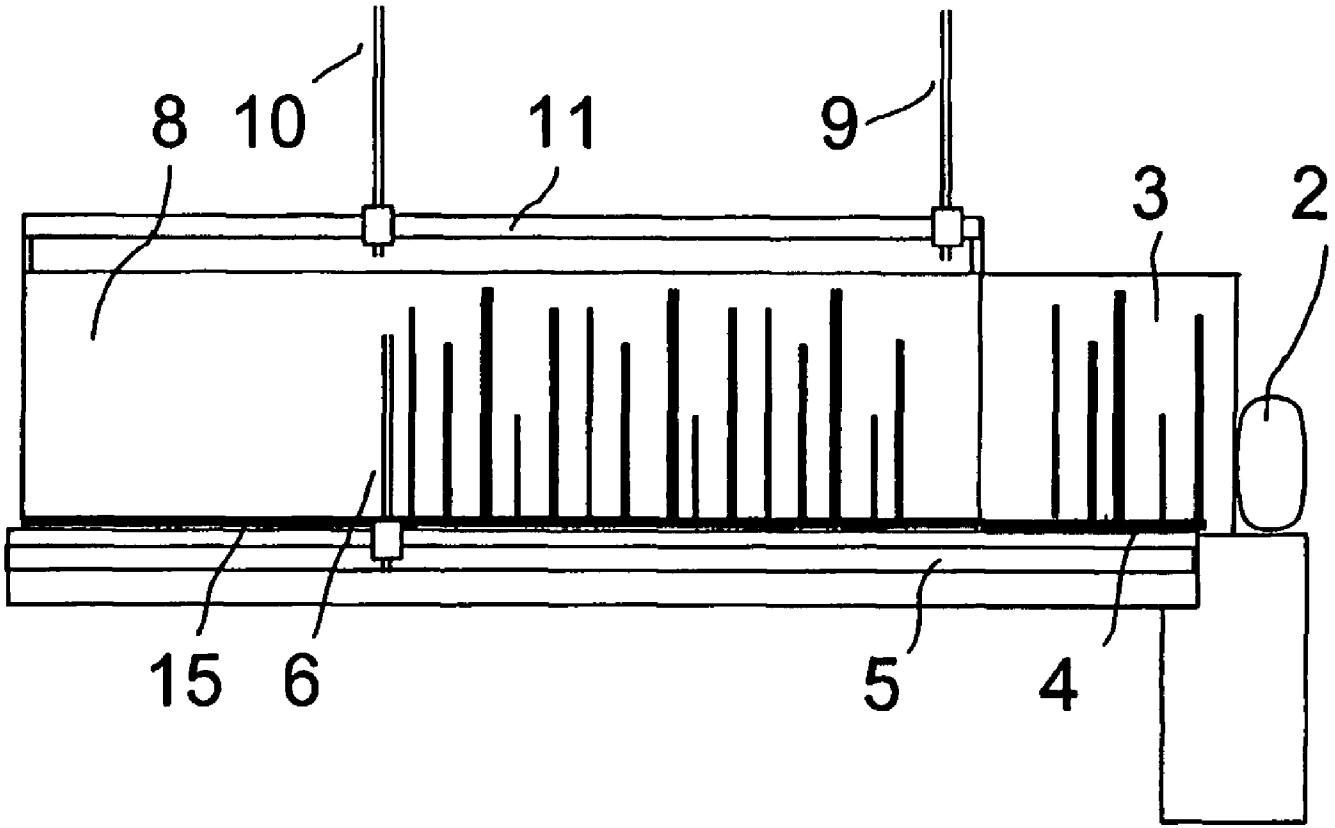

The respective second section 30 is first of all docked in extension to the first section 20 of the mail conveyor line of the input unit. The two separating blades 9, 10 are then moved with the first stack to the first separating blade 6. The first separating blade 6 of the input unit is then swivelled upwards and inserted again behind the stack and the rear separating blade 10 of the second section 30. After tilting upward of the separating blade 9, 10 of the second section 30, the separation can be started (FIG. 3*a-c*). Has the second section 30 run down because of separation, the remaining follow in the respective order.

The invention claimed is:

1. A method of providing letters to a letter sorting system, which comprises a letter isolating unit, a first conveyor line configured to convey letters along a transport direction to the letter isolating unit, and a second conveyor line configured to convey the letters to the first conveyor line, wherein the first conveyor line has a first separating blade and a linear guide to guide the first separating blade and to extend beyond a length of the first conveyor surface, and wherein the second conveyor line is mounted on a moveable carriage and has a second conveyor surface, at least one second blade, and a second linear guide configured to guide the at least one second blade, the method comprising the steps of:

loading a stack of letters on the second conveyor line, wherein the stack of letters has with respect to the transport direction a beginning and an end;

pivoting the at least one second blade into the second conveyor line to retain the stack of letters;

coupling the second conveyor line to the first conveyor line;

pivoting the fast separating blade out of the first conveyor line;

moving the first separating blade to the end of the stack of letters to support the stack of letters located on the second conveyor line;

pivoting the first separating blade into the second conveyor line;

pivoting the at least one second blade out of the second conveyor line; and uncoupling the second conveyor line from the first conveyor line to be loaded with another stack of letters, wherein the first separating blade is configured to move along the first and second conveyor lines.

2. The method of claim 1, further comprising moving the second conveyor line to a selected sorting compartment for loading the second conveyor line.

3. The method of claim 1, further comprising performing the uncoupling when the first conveyor line is free of letters.

* * * * *